US008512424B2

(12) United States Patent
Dorries et al.

(10) Patent No.: US 8,512,424 B2
(45) Date of Patent: Aug. 20, 2013

(54) CHAFING DISH FUEL

(75) Inventors: Duwaine Edward Dorries, Corona, CA (US); Kari Heaberlin, San Bernardino, CA (US); Jarrod Kuhn, Fountain Valley, CA (US); Ron Riley, Germantown, TN (US); Richard Eugene Miller, Murrieta, CA (US)

(73) Assignee: Candle Lamp Company, LLC

( * ) Notice: Subject to any disclaimer, the term of this patent is extended or adjusted under 35 U.S.C. 154(b) by 568 days.

(21) Appl. No.: 12/693,780

(22) Filed: Jan. 26, 2010

(65) Prior Publication Data

US 2010/0186286 A1 Jul. 29, 2010

Related U.S. Application Data

(60) Provisional application No. 61/147,678, filed on Jan. 27, 2009.

(51) Int. Cl.
*C10L 7/04* (2006.01)
*C10L 7/00* (2006.01)

(52) U.S. Cl.
USPC ..... 44/266; 44/265

(58) Field of Classification Search
USPC ..... 428/327; 424/78.09; 429/44; 44/266, 44/265
See application file for complete search history.

(56) References Cited

U.S. PATENT DOCUMENTS

2005/0130025 A1* 6/2005 Kadowaki et al. ..... 429/44
2005/0136247 A1* 6/2005 Sumiya et al. ..... 428/327
2009/0053166 A1* 2/2009 Niimoto ..... 424/78.09

OTHER PUBLICATIONS

27 CFR 21.151—List of Denaturants Authorized for Denatured Spirits. Aug. 18, 2010. <http://cfr.vlex.com/vid/151-denaturants-authorized-denatured-spirits> 6 pages.

* cited by examiner

*Primary Examiner* — Ellen McAvoy
*Assistant Examiner* — Chantel Graham
(74) *Attorney, Agent, or Firm* — Stetina Brunda Garred & Brucker

(57) ABSTRACT

A fuel gel including an alcohol, a nontoxic denaturant, a thickening agent, and at least one neutralizing agent is disclosed. An exemplary formulation includes corn-based ethanol, denatonium benzoate, acrylic acid homopolymers, diisopropanolamine, corn-based glycerin, and distilled water.

20 Claims, 1 Drawing Sheet

CHAFING DISH FUEL

CROSS-REFERENCE TO RELATED APPLICATIONS

This application claims the benefit of U.S. Provisional Application No. 61/147,678, filed on Jan. 27, 2009, the entirety of which is expressly incorporated by reference.

STATEMENT RE: FEDERALLY SPONSORED RESEARCH/DEVELOPMENT

Not Applicable

BACKGROUND

1. Field of the Invention

This invention relates to a fuel gel and processes for preparing the same. More particularly, this invention relates to an environmentally friendly fuel gel.

2. Description of Related Art

Gelled fuels can be used as sources for heating, such as for cooking with a chafing dish. In this setting, the gelled fuel is situated within a container located underneath a chafing dish and ignited to warm the food present within the chafing dish. There are two types of chafing fuels currently on the market. One chafing fuel is made from alcohol and the other uses a combustible liquid (commonly diethylene glycol) with a wick. For the alcohol chafing fuels, there are two types of alcohol commonly used: methanol or ethanol. When ethanol is used, regulations require that it be "denatured." The denaturization process simply means that something must be added to make the ethanol non-beverage grade. Alcohol containing such an addition is referred to by the regulations as "Specially Denatured Alcohol" or "SDA." Furthermore, when SDA is used for industrial purposes, it is not taxed like beverage alcohol. The U.S. Treasury Department's Tax and Trade Bureau's (TTB) regulations allow for the use of several different denaturants within different industrial areas. The non-toxic denaturant denatonium, which may be in the form of denatonium benzoate (commonly sold under the trade name BITREX®) or denatonium saccharide, is available under the TTB' s regulations as a denaturant for cosmetic products such as hair gel and the like, but has not previously been allowed for use in fuels.

U.S. Pat. No. 3,964,880 discloses a fuel paste including ethanol, a thickening agent, and an inorganic fuel carrier mixture of silicon dioxide and another compound.

U.S. Pat. No. 5,641,890 discloses gelled organic liquids containing a base neutralized anionic polymer and an auxiliary rheological additive.

BRIEF SUMMARY

The present invention is directed toward improved gelled fuels, and processes for preparing such gelled fuels. In particular, the present invention is directed toward "environmentally-friendly" gelled fuels that may be suitable for cooking and/or warming food. The environmentally-friendly gelled fuels of the present invention may utilize nontoxic and ingredients sourced from renewable materials, such as corn.

The fuel gel of the present invention includes an alcohol, a nontoxic denaturant, a thickening agent, and at least one neutralizing agent. An exemplary formulation of the present invention includes corn-based ethanol, denatonium benzoate, acrylic acid homopolymers, diisopropanolamine, corn-based glycerin, and distilled water.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
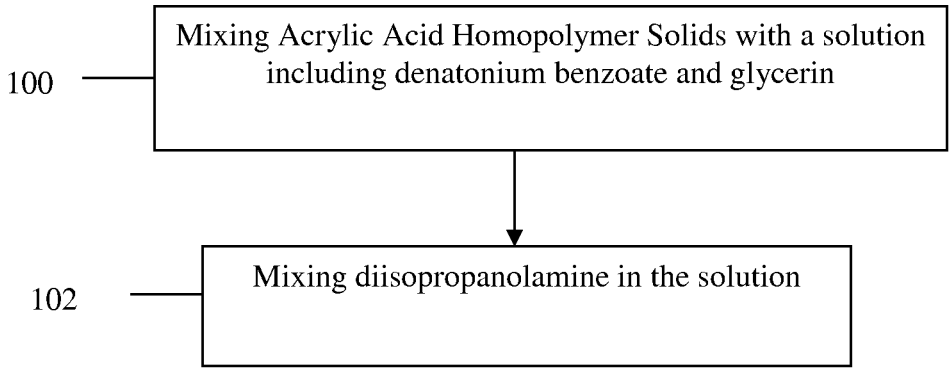
FIG. 1 is a flow chart of a first exemplary process.
Figure 2:
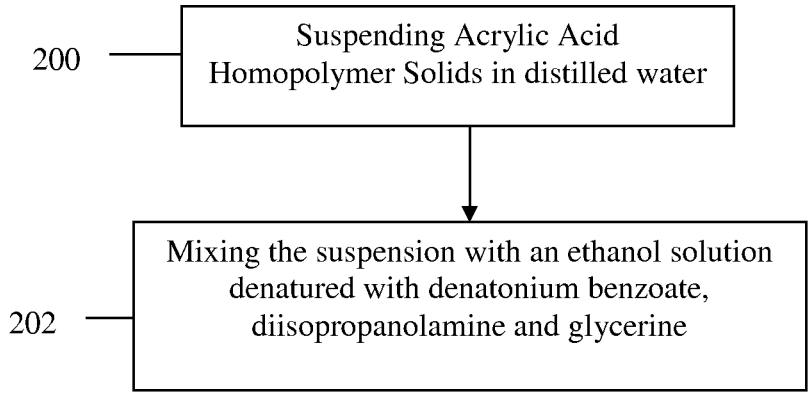
FIG. 2 is a flow chart of a second exemplary process.

The detailed description set forth below is intended as a description of the presently preferred embodiment of the invention, and is not intended to represent the only form in which the present invention may be constructed or utilized. The description sets forth the functions and sequences of steps for constructing and operating the invention. It is to be understood, however, that the same or equivalent functions and sequences may be accomplished by different embodiments and that they are also intended to be encompassed within the scope of the invention.

A fuel gel that may be used as a chafing dish fuel is disclosed. In one embodiment, the fuel gel is made up of an alcohol, a nontoxic denaturant, a thickening agent, and a neutralizing agent.

Although numerous alcohols may be utilized, including methanol, a preferred embodiment utilizes ethanol as the alcohol. In particular, the use of corn as the starting material to formulate the ethanol allows for the use of a renewable material as the source of the fuel gel's main ingredient.

Although there are numerous denaturants known and available, the use of a nontoxic denaturant is envisioned. One such nontoxic denaturant that is particularly useful is denatonium. Denatonium is extremely bitter, but is not toxic. The denatonium may be in the form of denatonium benzoate or denatonium saccharide.

A thickening agent is used to jellify the alcohol solution. The thickening agent may be a carbomer, i.e., a synthetic polymer of acrylic acid. In particular, the thickening agent may be an acrylic acid homopolymer.

Furthermore, a neutralizing agent is also required to gel the alcohol solution. The neutralizing agent may be any strong nucleophilic base. Examples of neutralizing agents include, but are not limited to, diisopropanolamine, alumina, and sodium hydroxide. The polyacrylic gel is slightly acidic and will undergo an acid-base neutralization reaction with the surrounding medium. By introducing a nucleophilic base, the acrylic polymers will exchange protons with the base and allow the polymers to bond together thereby jellifying the solution.

Additionally, the fuel gel may further include a second neutralizing agent. For example, if the first neutralizing agent is diisopropanolamine, the second neutralizing agent may be alumina. The alumina may be in the form of a hydrate solution.

The fuel gel may optionally include a coloring agent. For example, the fuel gel may include a dye, such as a green dye. Additionally, or alternatively, the fuel gel may include glycerin to color the flame. The fuel gel, when including glycerin, will burn with a strong yellow flame, similar to the appearance of the cellulose-based combustion of wood or wax. As such, the addition of glycerin may provide an additional aesthetic component to the fuel gel enabling its use as an attractive heat source, for example in a chimneyless fireplace.

The fuel gel may further include distilled water to produce a desired consistency or viscosity.

One embodiment of the fuel gel may have the following Formula 1:

65% to 85% alcohol denatured with a nontoxic compound;

0.1% to 1.0% thickening agent;

0.1% to 1.5% neutralizing agent;

2% to 10% glycerin; and

5% to 20% distilled water Formula 1

A more specific formulation of the present invention is disclosed in the following Formula 2:

70% to 80% ethanol denatured with denatonium benzoate;

0.3% to 1.0% acrylic acid homopolymer;

0.5% to 1.5% diisopropanolamine;

4% to 7% glycerin; and

15% to 20% distilled water Formula 2

The fuel gel preferably has a viscosity between 45,000 and 85,000 centipoises and a pH between 6.9 and 7.5. A particularly preferred embodiment has a viscosity of 70,500 centipoises and a pH of 7.1. Further, the fuel gel typically has an average burn rate of approximately three grams per minute.

A process for preparing the fuel gel discussed herein may include mixing carbomer solids with a liquid solution containing an alcohol fuel, and then mixing the resulting solution with a neutralizing agent to jellify the composition. In an exemplary process, acrylic acid homopolymer solids may be mixed 100 with a liquid fuel solution containing 76% ethanol denatured with denatonium benzoate, 5% glycerin, and 19% distilled water. The acrylic acid solids may be mixed with this liquid fuel solution by blending. This resulting fuel solution may then be jellified by mixing 102 it with diisopropanolamine until the desired viscosity is reached.

An alternative process may instead include first suspending 200 the acrylic acid homopolymer solids in distilled water and then mixing 202 the suspension with a solution of ethanol denatured with denatonium benzoate, diisopropanolamine, and glycerin.

The fuel gel as disclosed above has its greatest viscosity at a neutral pH, which can be adjusted by an acid-base titration. Once the gel is blended, it can be poured into an appropriate fixture or container for use as a heat source. For example, 500 grams of the fuel gel may be placed into a container. In this example, once ignited the gel will undergo combustion over a two to three hour period.

The above description is given by way of example, and not limitation. Given the above disclosure, one skilled in the art could devise variations that are within the scope and spirit of the invention disclosed herein, including using various carbomers, thickening agents, and neutralizing agents. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A fuel gel comprising an alcohol, a nontoxic denaturant, a thickening agent, and a neutralizing agent, wherein the fuel gel has a viscosity between 45,000 and 85,000 centipoises and a pH between 6.9 and 7.5.

2. The fuel gel of claim 1, wherein the alcohol is ethanol.

3. The fuel gel of claim 1, wherein the nontoxic denaturant is denatonium benzoate.

4. The fuel gel of claim 1, wherein the thickening agent is a carbomer.

5. The fuel gel Of claim 4, wherein the carbomer is an acrylic acid homopolymer.

6. The fuel gel of claim 1, wherein the neutralizing agent is selected from the group consisting of diisopropanolamine, alumina, and sodium hydroxide.

7. The fuel gel of claim wherein the neutralizing agent is diisopropanolamline.

8. The fuel gel of claim 1 further comprising a second neutralizing agent.

9. The fuel gel of claim 8, wherein the neutralizing agent is diisopropanolamine and the second neutralizing agent is alumina.

10. The fuel gel of claim 1 further comprising a coloring agent.

11. The fuel gel of claim 10, wherein the coloring agent is a dye.

12. The fuel gel of claim 10, wherein the coloring agent is glycerin.

13. The fuel gel of claim 1 further comprising distilled water.

14. A fuel gel comprising the following formula:

65% to 85% alcohol denatured with a nontoxic compound;

0.1% to 1.0 thickening agent;

0.1% to 1.5% neutralizing agent;

2% to 10% glycerin; and

5% to 20% distilled water.

15. The fuel gel of claim. 14 comprising the following formula:

70% to 80% ethanol denatured with denatonium benzoate;

0.3% to 1.0% acrylic acid homopolymer;

0.5% to 1.5% diisopropanolamine;

4% to 7% glycerin; and

15% to 20% distilled water.

16. The fuel gel of claim 1, wherein the fuel gel has a viscosity 70,500 centipoises and a pH of 7.1.

17. The fuel gel of claim 14, wherein the alcohol is ethanol.

18. The fuel gel of claim 14, wherein the nontoxic denaturant is denatoninin benzoate.

19. The fuel gel of claim 14, wherein the thickening agent is a carbomer.

20. The fuel gel of claim 14, wherein the neutralizing agent is selected from the group contesting of diisopropanolamine, alumina, and sodium hydroxide.

* * * * *